United States Patent [19]

Popeski et al.

[11] Patent Number: 4,702,480

[45] Date of Patent: Oct. 27, 1987

[54] FLUSHING BOOTH TARGET APPARATUS

[76] Inventors: Fred Popeski, 1544 Taki Dr.; Keith Pierce, 1748 Clifford Dr., both of Erie, Pa. 16505

[21] Appl. No.: 848,646

[22] Filed: Apr. 7, 1986

[51] Int. Cl.[4] ..... A63F 9/02

[52] U.S. Cl. ..... 273/384; 4/597; 273/385

[58] Field of Search ..... 273/384, 385; 4/597, 4/602

[56] References Cited

U.S. PATENT DOCUMENTS

| | | | |
|---|---|---|---|
| 553,046 | 1/1896 | Wenger | 4/602 |
| 1,372,598 | 3/1921 | Buka | 4/602 X |
| 2,148,438 | 2/1939 | Crain et al. | 273/384 |
| 4,093,228 | 6/1978 | Pierce | 273/384 |

*Primary Examiner*—Anton O. Oechsle
*Attorney, Agent, or Firm*—Charles L. Lovercheck; Wayne L. Lovercheck; Dale R. Lovercheck

[57] ABSTRACT

A water entertainment apparatus and a method of operating the apparatus are provided. The water entertainment apparatus includes a flush toilet means, a target means, and a flush toilet support means. The flush toilet means includes a liquid reservoir member, bowl member and drain member. The target means includes a target surface member and an actuator means. The liquid reservoir member is connected to the bowl member and the bowl member is connected to the drain member. The target surface member is connected to the actuator means. The actuator means is connected to the water reservoir member. The flush toilet means is supported by the flush toilet support means. The method provides liquid in the liquid reservoir member of the water entertainment apparatus. Then a subject is positioned below the drain member. A projectile is then impacted on the target surface member. The target surface member then actuates the actuator means. The actuator means releases liquid from the liquid reservoir member through the bowl member and the drain member onto the subject.

20 Claims, 5 Drawing Figures

FLUSHING BOOTH TARGET APPARATUS

BACKGROUND OF THE INVENTION

The invention relates to an entertainment booth. The invention provides an improved entertainment booth in which water is flushed onto the booth occupant. The improvements of the invention each taken alone or in combination add to resolve the problems of the prior art.

Pierce, in U.S. Pat. No. 4,093,228, discloses a water dumping target game including a bucket having a release device for tilting the bucket. The release device includes a target. The bucket is adapted to be filled with water. When the target is struck with a missile it causes a release member to become disengaged, causing the bucket to swing and dump water onto the area below.

Griego et al, in U.S. Pat. No. 4,466,616, discloses a missle responsive amusement apparatus including a target mounted on one end of an elongated target arm, a seat release mechanism and a seat. The seat is adapted to swivel downward for dropping a person sitting thereupon into a tank of water below the seat.

Van Kannel, in U.S. Pat. No. 1,021,019 discloses an amusement apparatus similar to that of Pierce.

Hammet, U.S. Pat. No. 988,334 and Keller, U.S. Pat. No. 2,202,738, each disclose an amusement apparatus in which a person on a seat is swung to a chute and slides into a tank filled with water.

Hensler, in U.S. Pat. No. 41,773, discloses a bathing closet including an elevated tank having a valve connected to a cord for use as a shower-bath and a pan for fuel to heat the closet for a sweating bath.

One problem of the prior art is that the booth occupant is subject to severe injury due to the operation of the booth. For example, in some prior art booths, the occupant may be dropped against the structural members of a water tank.

Water entertainment booths of the prior art often are expensive, requiring a large tank and a large pool of water. Another problem of the prior art is a lack of creative entertainment value. Empathy for the booth occupant is diminished by some prior art water entertainment booth because the occupant is out of the sight of the observers for a substantial portion of the entertainment period. The play value of some prior art water entertainment is low because of the brief period in which the booth occupant is contacted with additional water. The improvements of the present invention beneficially provide a novel, non-obvious and useful manner of a structure for a water entertainment booth.

BRIEF DESCRIPTION OF THE INVENTION

These problems of the prior art are overcome by the improved water entertainment booth of the invention. The booth occupant is not subject to severe injury by dropping, sliding or otherwise moving the occupant in the operation of the water entertainment booth of the invention. Also, the entertainment value of the water entertainment booth of the invention is enhanced because all of the action is displayed to the observers in that the occupant does not drop out of sight.

In accordance with the invention, a water entertainment apparatus and a method of operating the apparatus are provided. The water entertainment apparatus includes a flush toilet, a target, and a flush toilet support. The flush toilet includes a liquid reservoir, bowl and drain. The target mechanism includes a target surface and an actuator mechanism. The liquid reservoir is connected to the bowl and the bowl is connected to the drain. The target surface is connected to the actuator mechanism. The actuator mechanism is connected to the water reservoir. The flush toilet is supported by the flush toilet support.

The method provides water in the container of the reservoir of the water entertainment apparatus. A booth occupant is positioned below the opening of the drain conduit. When a projectile is impacted on the target surface member by a player, the target surface moves actuating the actuator mechanism. The actuator mechanism releases liquid from the liquid container of the reservoir through the bowl and the drain conduit onto the booth occupant. The unique action of the dousing mechanism provides an initially gradual flow of water which builds over several seconds to a full flow and then subsides following a period of substantially constant flow.

BRIEF DESCRIPTION OF THE DRAWINGS

The objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
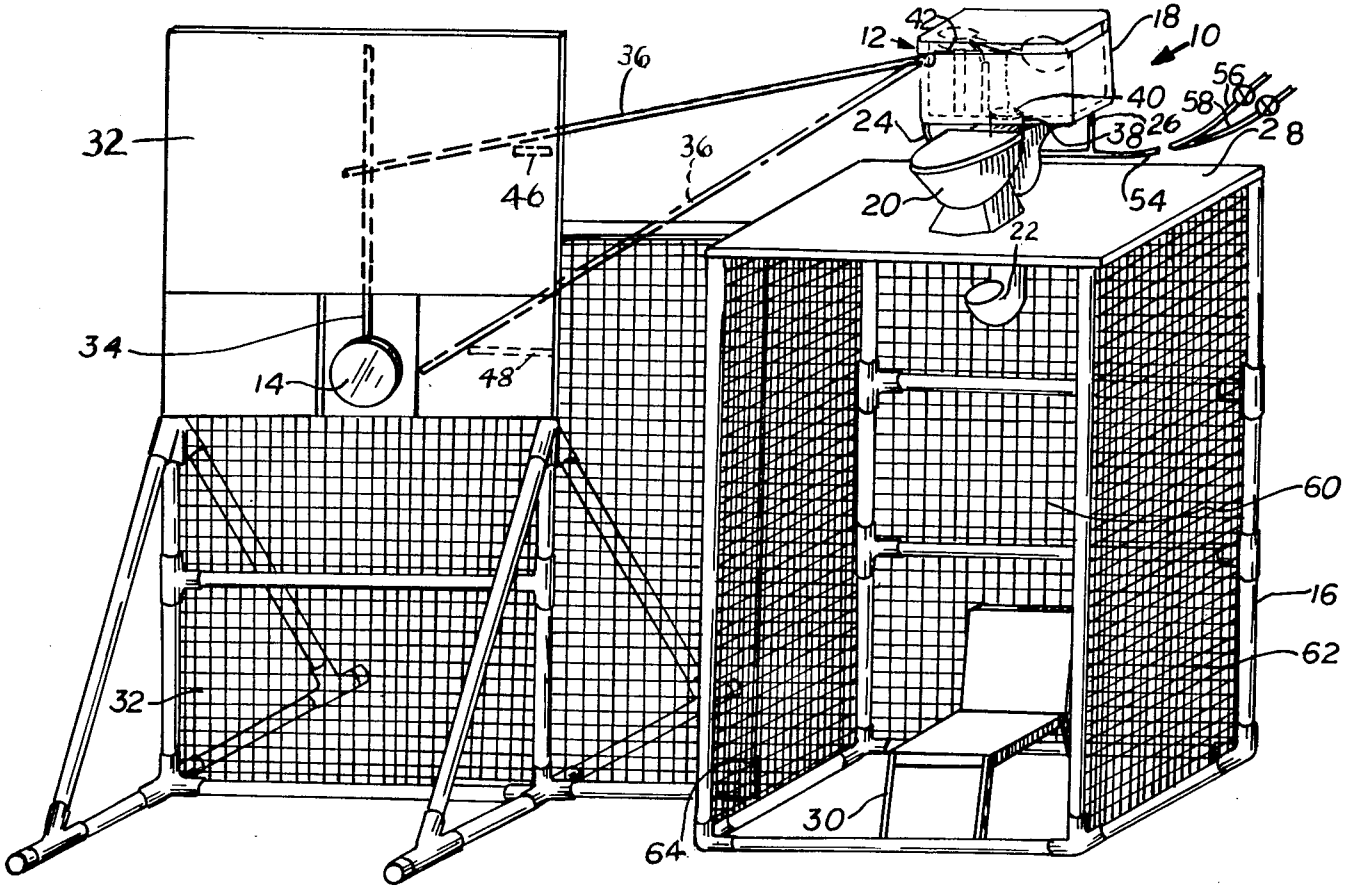
FIG. 1 is a front view of a preferred embodiment of a flushing booth in accordance with the invention.
Figure 2:
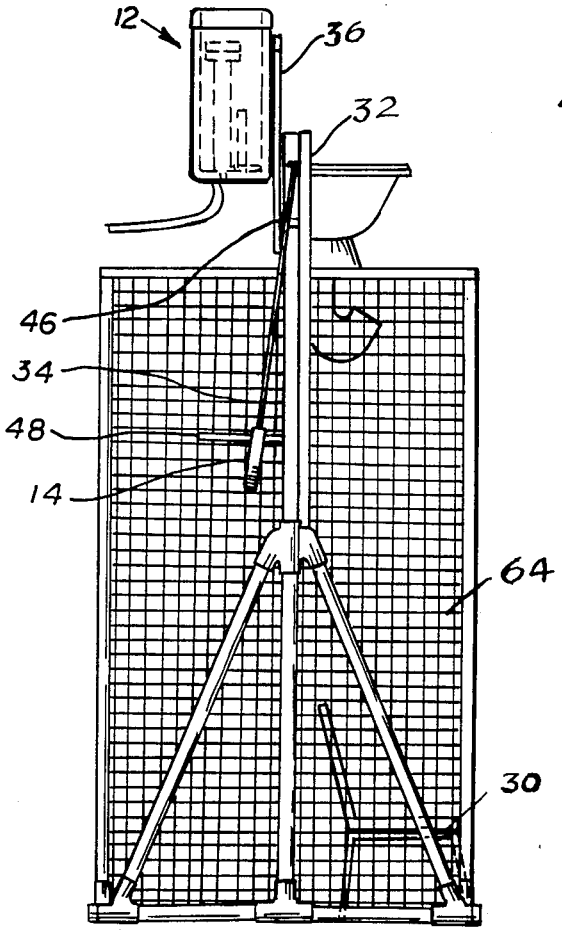
FIG. 2 is a side view of the preferred embodiment of the flushing booth in accordance with the invention shown in FIG. 1.
Figure 4:
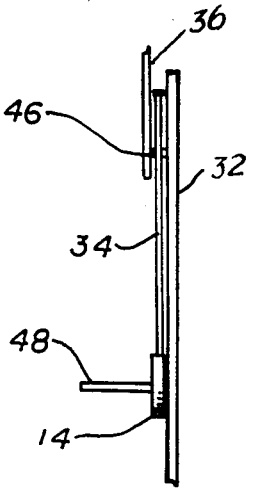
FIG. 4 is a partial side view of the actuating mechanism of the flushing booth in accordance with the invention shown in FIG. 1; and, FIG. 5 is a partial side view of the actuating mechanism shown as it is actuated by a projectile in accordance with the invention.
Figure 5:
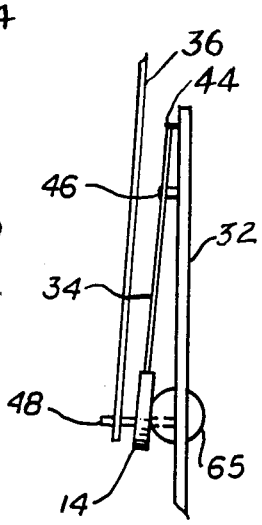
Figure 3:
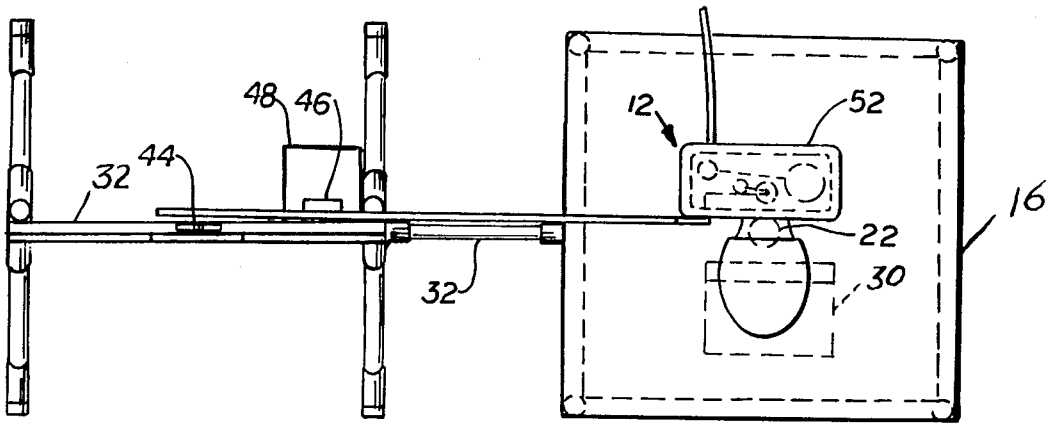
FIG. 3 is a top view of the preferred embodiment of the flushing booth in accordance with the invention shown in FIG. 1.

The preferred embodiment of the invention is illustrated by way of example in FIGS. 1 through 3. Referring to the Figures, in which like numerals refer to like portions thereof, FIG. 1 shows a flushing booth 10 in accordance with the present invention. The flushing booth 10 includes a flush toilet 12, a target 14 and a housing 16. The flush toilet 12 includes liquid reservoir 18, bowl 20 and drain 22. The liquid reservoir 18 is connected to liquid supply lines 24 and 26. The flush toilet 12 is supported by platform 28 of housing 16. A chair 30 is provided below drain 22. Target 14 is surrounded in its plane by target backstop 32. Target 14 is supported by target support arm 34. Reservoir drain actuator lever 36 is pivotally connected to the liquid reservoir 18.

Reservoir drain conduit 38 opens into bowl 20. Reservoir drain conduit stopper 40 closes the upper end of reservoir drain conduit 38 prior to actuation of lever 36. Reservoir drain conduit stopper 40 is supported by stopper support 42. Stopper support 42 is connected to reservoir drain actuator lever 36.

With more particular reference to FIGS. 2 and 3, it is seen that target support arm 34 is connected to pivotal support 44 which is supported on backstop 32. The upper catch 46 holds the reservoir drain actuator lever 36 in place until triggered. The lower catch 48 is longer than upper catch 46. Lower catch 48 is positioned to stop the reservoir drain actuator lever 36 after it is triggered by the impact of projectile 65 thrown by a player. This prevents the actuator lever 36 from overextending and breaking.

The bottom face 52 of the reservoir 18 is large in proportion to the diameter of the drain 22. The larger the volume of water in the reservoir 18 is in proportion to the diameter of the drain 22, the longer is the period of time for the water from the reservoir to flow through the drain. For about the same length of time water is flowing from the reservoir, it is drained onto the booth occupant. Preferably, the booth occupant is sitting in the chair 30. The longer the period of time that water is drained onto the booth occupant, the longer the period of high entertainment value.

The smaller the diameter of the drain, the longer the period of time for the water from the reservoir to flow through the drain. For a particular diameter of the drain, the larger the volume of water in the reservoir and the longer the period of time for the water from the reservoir to flow through the drain onto the occupant of the booth. The volume of water in the reservoir is at a maximum when the reservoir is about full.

Thus, the volume of the reservoir preferably is at least large enough in proportion to the diameter of the drain to result in an extended period of time for the water to flow from the reservoir when the reservoir is about full when the lever 36 is actuated. The water in the reservoir is preferably above the drain conduit 38. By raising the reservoir, the flow rate of water through the drain can be increased. Similarly, by lowering the reservoir in elevation in relation to the drain conduit 38, the flow rate of water through the drain can be decreased.

Each of the water supply lines 24 and 26 receives water through water feed line 54. For the comfort of the booth occupant, it is desirable to control the temperature of the water. The temperature may be controlled by hot water feed line 56 and cold water feed line 58. Water feed line 54 receives hot water through hot water feed line 56 and cold water through cold water feed line 58. The lines 56 and 58 each have a valve therein to adjust the flow rate of water therethrough and thus control the temperature of water feed to reservoir 18.

As a safety feature, the booth housing 16 of flushing booth 10 has a front screen 60 and side screens 62 and 64. These screens protect the booth occupant from projectiles 65 thrown by players at the target surface.

OPERATION OF THE PREFERRED EMBODIMENT

In operation, a player attempts to impact the target with a projectile 65, such as a soft ball, from a predetermined distance. When the target is impacted, it swings back and triggers the release mechanism. The weight of the actuator lever 36 causes the toilet to slowly flush. Water from the reservoir passes through the bowl out the drain and onto the booth occupant, who is sitting in the chair 30. The flow does not start immediately. After a brief delay, the flow of water begins and inreases to a substantially constant rate which may be maintained for a period of from about five to about eight seconds, and then tapers off until there is no longer any water flowing.

Preferably, there is a delay of at least one second between impacting of the target and the beginning of flow of water out of the drain. It is also preferred that the flow rate of water through the drain begins slowly and increases to a substantially constant rate over a period of at least two seconds followed by a period of flow at a substantially constant rate, followed by a period of decreasing flow rate.

The entertainment value of the flushing booth 10 is improved over prior art water entertainment booths because the occupant of the booth does not disappear from the sight of the observers during the entertainment period. The entertainment period for flushing booths in accordance with the present invention is longer than the entertainment period for flushing booths of the prior art. Both of these advantages increase the enjoyment for the observers.

Flushing booths in accordance with the present invention are safer than prior art water entertainment booths. The occupant of the booth of the present invention remains at about a constant elevation in the chair during the entertainment period. The occupant of the booths of the prior art are often suddenly dropped significant distances with the possibility of serious injury.

The foregoing specification sets forth the invention in its preferred, practical forms but the structure shown in capable of modification within a range of equivalents without departing from the invention which is to be understood is broadly novel as is commensurate with the appended claims.

The embodiments of the invention in which an exclusive property or privilege is claimed are defined as follows:

1. A water entertainment apparatus comprising:
support means,
a flush toilet means on said support means,
a target means,
said flush toilet means comprising water reservoir means, bowl means and drain means, said drain means having an outlet means at its lower end,
said target means comprising a target actuator means actuated in response to a projectile striking said target means,
drain actuator means,
said water reservoir means being connected to said bowl means and said bowl means being connected to said drain means,
said target actuator means being connected to said drain actuator means,
stopper means between said water reservoir means and said bowl means,
said drain actuator means being connected to said stopper means,
occupant support means on said apparatus below said outlet means of said drain means whereby water from said drain means may engage an occupant on said occupant support means when said toilet is flushed by a projectile striking said target actuator means.

2. The water entertainment apparatus recited in claim 1 wherein said water reservoir means comprises container means, first water feed conduit and second water feed conduit,
said first water feed conduit and said second water feed conduit being connected to said container means.

3. The water entertainment apparatus recited in claim 2 wherein said target means further comprises a target backstop.

4. The water entertainment apparatus recited in claim 3 wherein said drain actuator means comprises a reservoir drain actuator lever, a first catch member and a second catch member, said reservoir drain activator lever being adapted to be supported by said first catch member.

5. The water entertainment apparatus recited in claim 1 wherein said support means comprises a platform, a plurality of wall members, said platform being supported by said wall members.

6. The water entertainment apparatus recited in claim 5 wherein said occupant support means comprises a chair, said chair being positioned below said outlet means of said drain means.

7. The water entertainment apparatus recited in claim 1 wherein said water reservoir means comprises container means, said drain means comprises conduit means and the diameter of said conduit means is small in proportion to the volume of said container means, whereby said water entertainment apparatus is adapted for dispensing water from said container means through said drain conduit for a predetermined period of time and water is dispersed for a portion of said period of time at a substantially constant rate.

8. The water entertainment apparatus recited in claim 1 wherein said target means is disc-shaped, and a planar surface of said target means facing a player positioned to impact said planar surface with a projectile.

9. A method of operating a water entertainment apparatus comprising:

providing a water entertainment apparatus, said apparatus comprising a flush toilet means, a target means and a support means, said flush toilet means comprising liquid reservoir means, stopper means, bowl means and drain means, said drain means including an outlet means at the lower end thereof, said target means comprising a target actuator means and drain actuator means, said liquid reservoir means being connected to said bowl means with said stopper means therebetween and said bowl means being connected to said drain means, said target actuator means being connected to said drain actuator means, said drain actuator means being connected to said stopper means, said flush toilet means being supported by said support means, providing liquid in said liquid reservoir means, providing a subject below said outlet means of said drain means, impacting said target actuator means with a projectile, whereby said target actuator means actuates said drain actuator means, said drain actuator means releases liquid from said liquid reservoir means through said bowl means and said drain means onto said subject.

10. The method of operating a water entertainment apparatus recited in claim 9 wherein said water reservoir means comprises container means, first water feed conduit and second water feed conduit, said first water feed conduit for cold water and said second water feed conduit for hot water being connected to said container means whereby the temperature of water to said subject can be controlled.

11. The method of operating a water entertainment apparatus recited in claim 10 wherein said target means further comprises a target backstop.

12. The method of operating a water entertainment apparatus recited in claim 11 wherein said drain actuator means comprises a reservoir drain actuator lever, a first catch member and a second catch member, said reservoir drain activator lever being adapted to be supported by said first catch member.

13. The method of operating a water entertainment apparatus recited in claim 12 wherein said support means comprises a platform, a plurality of wall members, said platform being supported by said wall members.

14. The method of operating a water entertainment apparatus recited in claim 13 in combination with a chair for subjects, said chair being positioned below said outlet means of said drain means.

15. The method of operating a water entertainment apparatus recited in claim 9 wherein said actuator means releases liquid from said liquid reservoir means through said bowl means and said drain means onto said subject for a period of time from five to eight seconds.

16. The method of operating a water entertainment apparatus recited in claim 15 wherein said release of liquid from said drain means begins after at least one second elapses after said actuation of said actuation means.

17. The method of operating a water entertainment apparatus recited in claim 15 wherein said water reservoir means comprises container means, said drain means comprises conduit means and the diameter of said conduit means is small in proportion to the volume of said container means, whereby said water entertainment apparatus is adapted for dispensing water from said container means through said drain conduit at a substantially constant rate for at least two seconds.

18. The method of operating a water entertainment apparatus recited in claim 17 wherein said water entertainment apparatus is adapted for dispensing water from said container means through said drain conduit at a substantially constant rate for at least five seconds.

19. The method of operating a water entertainment apparatus recited in claim 17 wherein said water entertainment apparatus is adapted for dispensing water from said container means through said drain conduit at a substantially constant rate for between five and eight seconds.

20. The method of operating a water entertainment apparatus recited in claim 19 wherein said target means is disc-shaped, and a planar surface of said target means faces a player, who may impact said planar surface with a projectile.

* * * * *